US008132411B2

(12) United States Patent
Xu et al.

(10) Patent No.: US 8,132,411 B2
(45) Date of Patent: Mar. 13, 2012

(54) RANKINE CYCLE FOR LNG VAPORIZATION/POWER GENERATION PROCESS

(75) Inventors: Jianguo Xu, Wrightstown, PA (US); Donn Michael Herron, Fogelsville, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 557 days.

(21) Appl. No.: 12/266,161

(22) Filed: Nov. 6, 2008

(65) Prior Publication Data

US 2010/0107634 A1 May 6, 2010

(51) Int. Cl.
*F01K 25/06* (2006.01)

(52) U.S. Cl. ..... 60/649; 60/651; 60/671

(58) Field of Classification Search ..... 60/648, 60/649, 651, 671
See application file for complete search history.

(56) References Cited

U.S. PATENT DOCUMENTS

| | | | | |
|---|---|---|---|---|
| 3,479,832 A | | 11/1969 | Sarsten et al. | |
| 4,178,761 A | * | 12/1979 | Schwartzman | 60/648 |
| 4,372,124 A | | 2/1983 | Newton et al. | |
| 4,400,947 A | * | 8/1983 | Ruhemann | 60/648 |
| 4,437,312 A | | 3/1984 | Newton et al. | |
| 4,444,015 A | * | 4/1984 | Matsumoto et al. | 60/648 |
| 4,479,350 A | | 10/1984 | Newton et al. | |
| 4,995,234 A | * | 2/1991 | Kooy et al. | 60/648 |
| 5,483,806 A | | 1/1996 | Miller et al. | |

FOREIGN PATENT DOCUMENTS

| | | |
|---|---|---|
| DE | 38 36 061 A1 | 6/1989 |
| EP | 0 009 387 A1 | 4/1980 |
| FR | 2 496 754 A1 | 6/1982 |
| GB | 2 079 857 A | 1/1982 |
| WO | 2006/019900 A1 | 2/2006 |
| WO | 2006/036441 A1 | 4/2006 |

* cited by examiner

*Primary Examiner* — Hoang Nguyen
(74) *Attorney, Agent, or Firm* — Eric J. Schaal

(57) ABSTRACT

A method and system for generating power in a vaporization of liquid natural gas process, the method comprising pressurizing a working fluid; heating and vaporizing the working fluid; expanding the working fluid in one or more expanders for the generation of power, the working fluid comprises: 2-11 mol % nitrogen, methane, a third component whose boiling point is greater than or equal to that of propane, and a fourth component comprising ethane or ethylene; cooling the working fluid such that the working fluid is at least substantially condensed; and recycling the working fluid, wherein the cooling of the working fluid occurs through indirect heat exchange with a pressurized liquefied natural gas stream in a heat exchanger, and wherein the flow rate of the working fluid at an inlet of the heat exchanger is equal to the flow rate of the working fluid at an outlet of the heat exchanger.

20 Claims, 6 Drawing Sheets

400
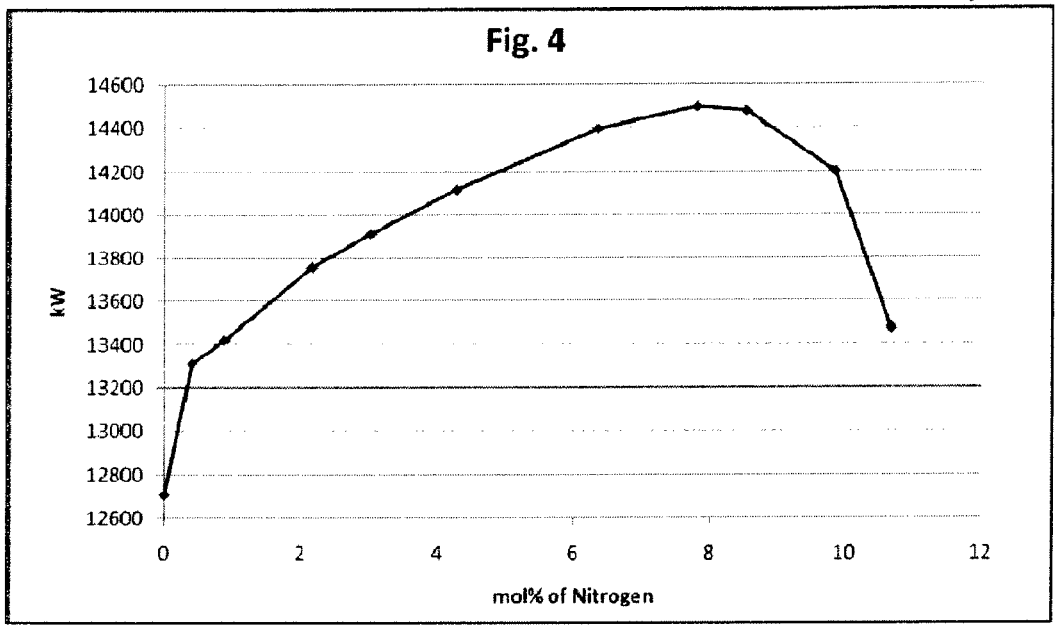
500
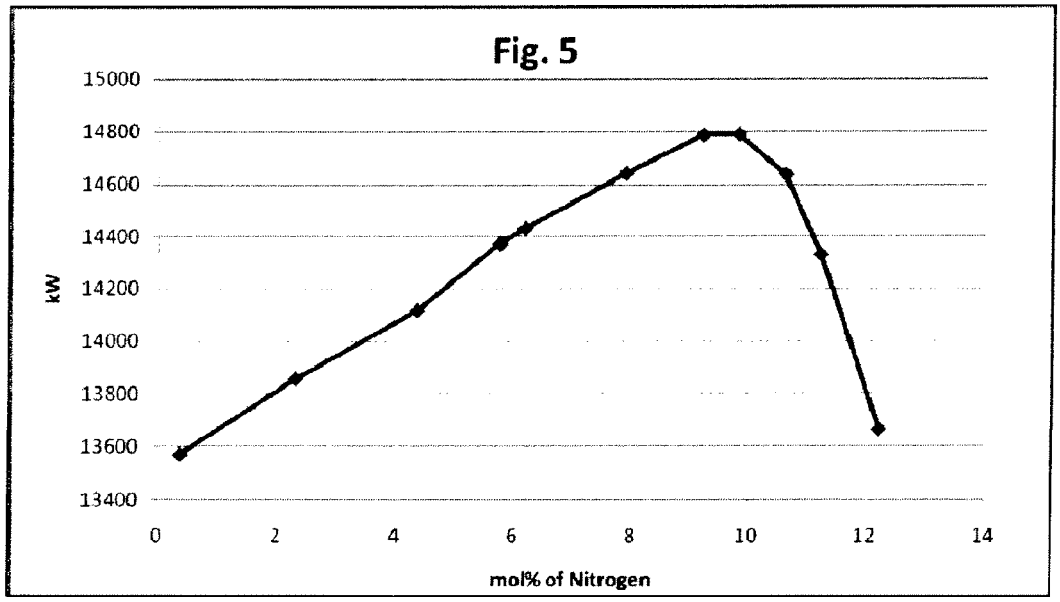

600
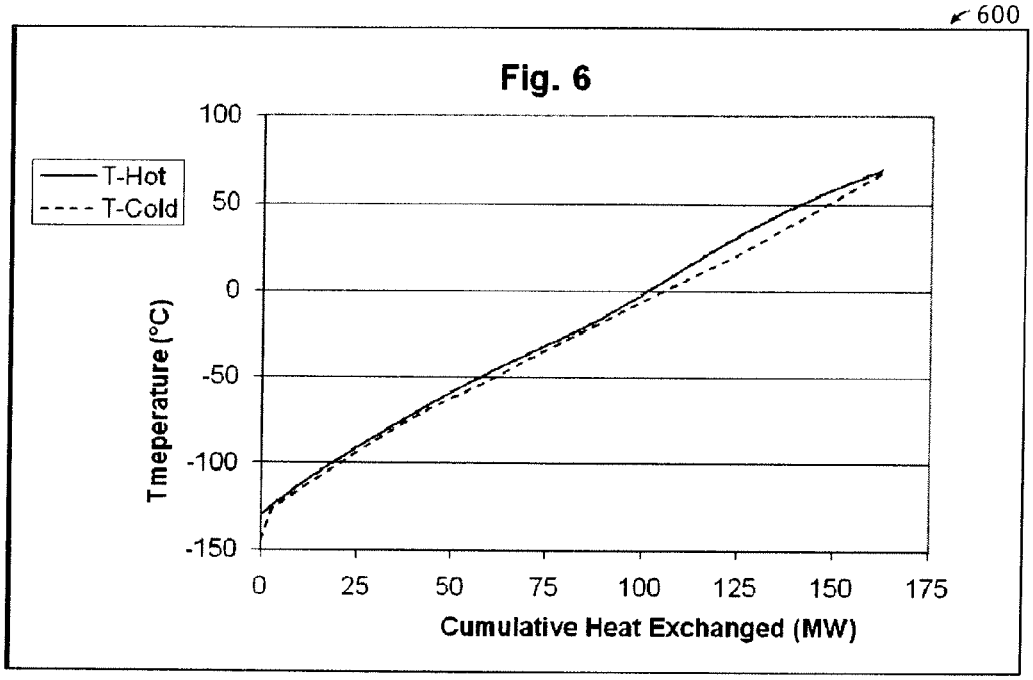
700
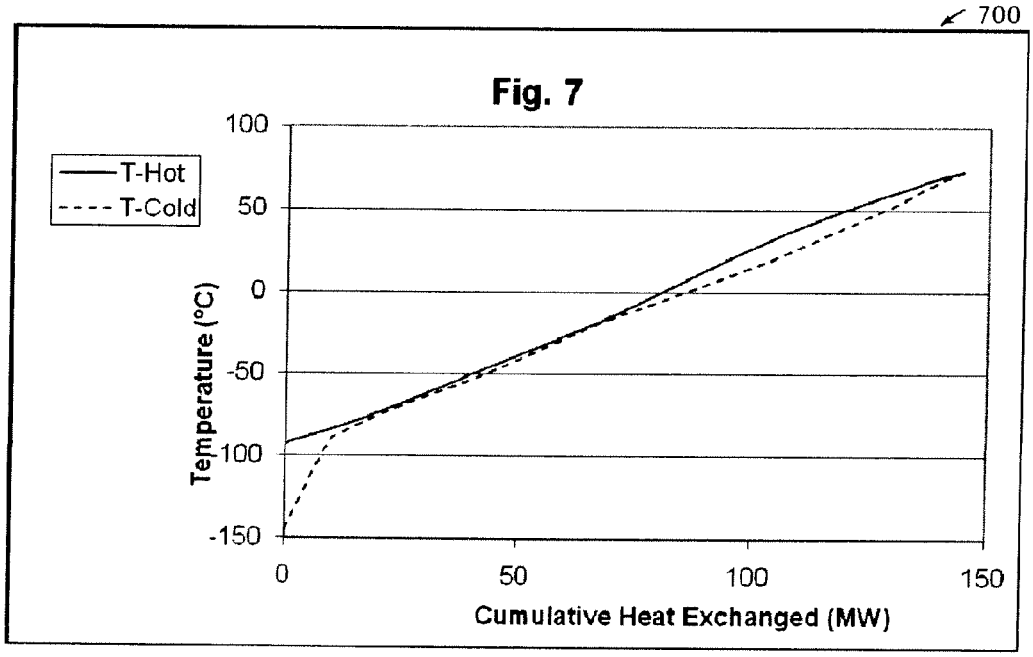

RANKINE CYCLE FOR LNG VAPORIZATION/POWER GENERATION PROCESS

BACKGROUND

Safe and efficient transfer of natural gas (NG) requires that the natural gas be liquefied prior to shipment. Once the liquefied natural gas (LNG) arrives at the target location, the natural gas must be regasified before it can be used as a fuel source. The regasification or vaporization of the liquefied natural gas, which requires input of work or heat, provides an opportunity for secondary power generation that uses the initially cold temperatures of the liquefied natural gas and the work or heat input for vaporization.

Previous known processes for generating power in association with vaporization of liquefied natural gas, however, were less than optimal for several reasons. For example, processes where the working fluid was only partially condensed were known to cause complexities, including the need for phase separators, which in turn increased costs and perhaps more importantly, rendered the processes more difficult to control and more sensitive to upsets that might unduly stress heat exchange equipment. Moreover, some processes suffered from thermodynamic inefficiencies due to mixing losses when the streams with different compositions were combined. Finally, the known processes did not disclose use of natural gas as a component of the working fluid.

BRIEF SUMMARY

Embodiments of the present invention satisfy a need in the art by providing a system and process for generating power in association with a vaporizing of liquefied natural gas process without the historical drawbacks.

According to one embodiment, a method is disclosed for generating power in a vaporization of liquid natural gas process, the method comprising the steps of: (a) pressurizing a working fluid; (b) heating and vaporizing the pressurized working fluid; (c) expanding the heated and vaporized working fluid in one or more expanders for the generation of power, the working fluid exiting the one or more expanders comprises: 2-11 mol % nitrogen, methane, a third component whose boiling point is greater than or equal to that of propane, and a fourth component comprising ethane or ethylene; (d) cooling the expanded working fluid such that the cooled working fluid is at least substantially condensed; and (e) recycling the cooled working fluid into step (a), wherein the cooling of the expanded working fluid occurs through indirect heat exchange with a pressurized liquefied natural gas stream in a heat exchanger, and wherein the flow rate of the expanded working fluid at an inlet of the heat exchanger is equal to the flow rate of the expanded working fluid at an outlet of the heat exchanger.

According to another embodiment, a method is disclosed for generating power in a vaporization of liquid natural gas process, the method comprising the steps of: (a) pressurizing a working fluid; (b) heating and vaporizing the pressurized working fluid; (c) expanding the heated and vaporized working fluid in one or more expanders for the generation of power, wherein the working fluid comprises: 2-11 mol % nitrogen, natural gas, a third component whose boiling point is greater than or equal to that of propane, and a fourth component comprising ethane or ethylene; (d) cooling the expanded working fluid such that the cooled working fluid is at least partially condensed; and (e) recycling the at least partially condensed working fluid into step (a), wherein the cooling of the expanded working fluid occurs through indirect heat exchange with a pressurized liquefied natural gas stream in a heat exchanger, and wherein the flow rate of the expanded working fluid at an inlet of the heat exchanger is equal to the flow rate of the expanded working fluid at an outlet of the heat exchanger.

According to yet another embodiment, a method is disclosed for generating power in a vaporization of liquid natural gas process, the method comprising the steps of pressurizing a working fluid; heating and vaporizing the pressurized working fluid; expanding the heated and vaporized working fluid in one or more expanders for the generation of power; cooling the expanded working fluid; and recycling the cooled working fluid wherein the cooling of the expanded working fluid occurs through indirect heat exchange with a pressurized liquefied natural gas stream in a heat exchanger, where the improvement comprises a working fluid comprising 2-11 mol % nitrogen and wherein the cooled working fluid is at least substantially condensed.

According to yet another embodiment, an apparatus is disclosed for power generation for use in a vaporization of liquefied natural gas system, the apparatus comprising: at least one expansion device; at least one heating device; at least one condenser; and a working liquid having multiple components, wherein the working liquid comprises: 2-11 mol % nitrogen, a second component comprising methane or natural gas, a third component whose boiling point is greater than or equal to that of propane, and a fourth component comprising ethane or ethylene

BRIEF DESCRIPTION OF THE DRAWINGS

The foregoing brief summary, as well as the following detailed description of exemplary embodiments, is better understood when read in conjunction with the appended drawings. For the purpose of illustrating embodiments of the invention, there is shown in the drawings exemplary embodiments of the invention; however, the invention is not limited to the specific methods and instrumentalities disclosed. In the drawings:

FIG. 4 is graphical illustration comparing the nitrogen content of the working fluid with the net recovered power in accordance with an embodiment of the present invention;

FIG. 5 is graphical illustration comparing the nitrogen content of the working fluid with the net recovered power in accordance with an embodiment of the present invention;

FIG. 6 is a graphical illustration of an exemplary cooling curve of the main heat exchanger when the nitrogen content of the working fluid was approximately 7.81 mol % in accordance with an embodiment of the present invention; and FIG. 7 is a graphical illustration of an exemplary cooling curve of the main heat exchanger when the nitrogen content of the working fluid was approximately 0.40 mol % in accordance with an embodiment of the present invention.

DETAILED DESCRIPTION OF EXEMPLARY EMBODIMENTS

Figure 1A:
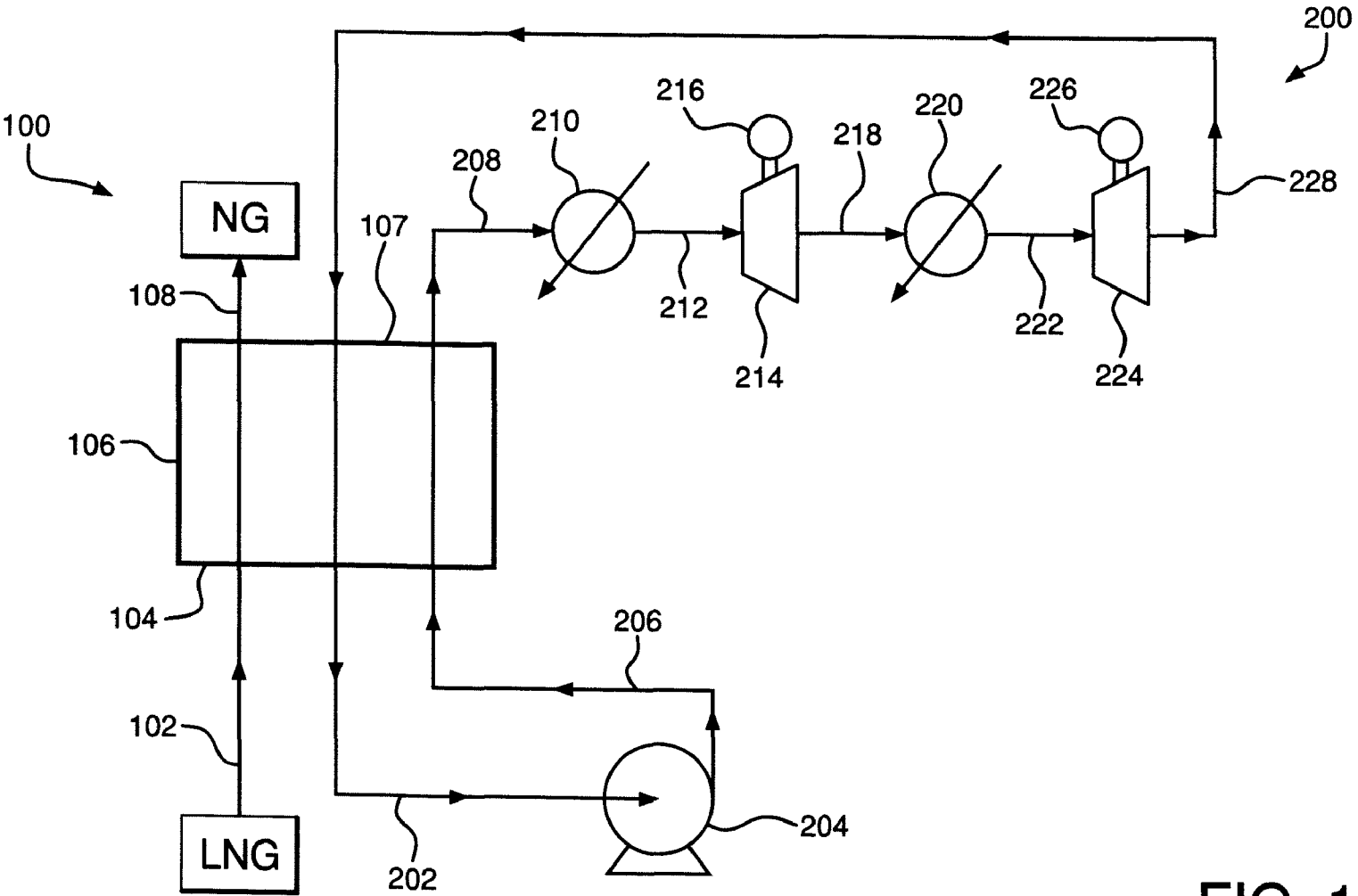
FIG. 1*a* is a flow diagram illustrating an exemplary power generation system in accordance with an embodiment of the present invention.

FIG. 1*a* is a diagram illustrating an exemplary power generation system including aspects of the present invention. A pressurized liquefied natural gas (LNG) stream may be fed through line 102 through the cold end 104 of the main heat exchanger 106 to generate pressurized natural gas (NG) in line 108 of the liquid natural gas vaporization loop 100. The delivery pressure of the natural gas may be 76 bar absolute, for example.

With respect to the power generation loop 200, working fluid in line 202 may be pressurized by the pump 204 and the pressurized working fluid in line 206 may then be sent through the cold end 104 of the main heat exchanger 106. After the pressurized working fluid is heated in the main heat exchanger 106, the pressurized working fluid in line 208 may be further heated and completely vaporized by a heater 210. The pressurized working fluid may be completely vaporized working fluid in line 212. The completely vaporized working fluid in line 212 may then be expanded in the expander 214. The work generated by expander 214 may be converted into, for example, electrical energy through the use of a generator 216. The exhaust working fluid from expander 214 in line 218 may be optionally further heated in a reheater 220. One or more reheaters may be used in between the one or more expanders, for example. The resultant working fluid stream in line 222 may be optionally further expanded in expander 224. Similar to expander 214, the work generated from expander 224 may be converted into, for example, electrical energy through the use of a generator 226. The exhaust working fluid from expander 224 in line 228 may then be fed into the warm end 107 of the main heat exchanger 106 for cooling and condensing of the working fluid. The cooled and condensed working fluid, that is now liquid working fluid, may then be recycled back into line 202 for repressurization. The process of the foregoing description is often referred to as a Rankine cycle.

The main heat exchanger 106 may be, for example, one or more physical heat exchangers. The one or more heat exchangers may be of the plate-fin heat exchanger type and measure 1.2 meters×1.3 meters×8 meters, for example.

While expander 214 in FIG. 1 may be interpreted as being a single expander, it should be noted that expander 214 may also be interpreted to represent one or more expanders for expansion, for example. The optional expander 224 may also be one or multiple physical devices.

The liquid natural gas flow to heat exchanger 106 may be about 10,068 kmol/hr, for example. In such a scenario, Expander 214 may produce 4000 kW-8000 kW of power, for example. Optional expander 224 may produce 7,000 kW-15,000 kW of power, for example. The typical pressure for the low pressure working fluid in line 202 may be 10 bar to 25 bar, for example. The typical pressure for the high pressure working fluid in line 206 may be 60 bar to 80 bar, for example. The power needed to drive pump 204 may be in the range of 2,000 kW to 4000 kW, for example. Typical temperatures exiting heater 210 and the optional reheater 220 may be in the range of 40° C. to 250° C., for example.

The working fluid exiting the one or more expanders of the power generation cycle may include the components of, for example, nitrogen, methane, and a third component whose boiling point is greater than or equal to propane. The third component may be, for example, any normal alkane, their respective isomers, (e.g., propane, isobutane, butane, pentane, isopentane, hexane) or any combination thereof. Moreover, the number of components of the working fluid may include more than three components. For example, a fourth component may be, for example, ethylene, ethane, propylene, or dimethyl ether (DME).

The nitrogen content of the working fluid may be greater than 2 mol %. For example, the nitrogen content of the working fluid may be between 2-11 mol %, and more preferably, between 6-10.6 mol %.

In another embodiment, the working fluid exiting the expanders of the power generation cycle may include the components of, for example, natural gas, nitrogen, and a third component whose boiling point is greater than or equal to the boiling point of propane. The third component, for example, may be any normal alkane, their respective isomers, (e.g., propane, isobutene, butane, pentane, isopentane, hexane), or any combination thereof. Because the naturally occurring amounts of nitrogen in the natural gas may be low, nitrogen may be added to this mixture of natural gas and the third component. Moreover, the number of components of the working fluid in this embodiment may include more than three components. For example, a fourth component may be, for example, ethylene, ethane, propylene, or dimethyl ether (DME) Liquefied natural gas, which typically already contains methane, ethane, and sometimes nitrogen, may be used as the base for forming the working fluid. For example, adding nitrogen, ethane, and pentane into the liquefied natural gas results in such a mixture.

Figure 2:
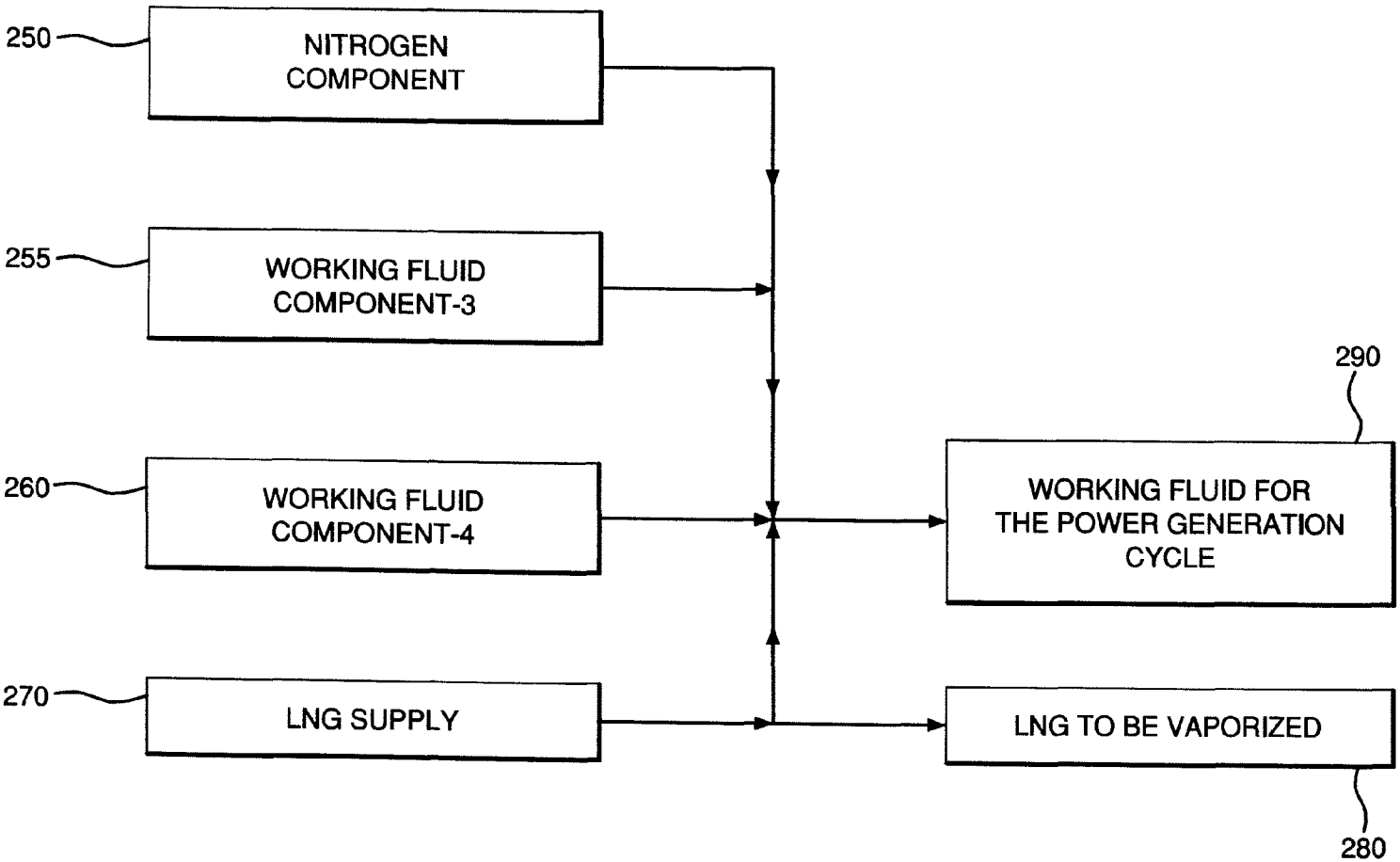
FIG. 2 is a flow diagram illustrating an exemplary use of liquid natural gas as a component of the working fluid in a power generation system in accordance with an embodiment of the present invention.

Use of natural gas as a component for the working fluid significantly saves money and resources because the use of natural gas as a component reduces the need to import and/or store at least some of the components already present in natural gas. The natural gas is already present on site for use in the vaporization portion of the process. For example, as illustrated in FIG. 2, three small tanks 250, 255, and 260 may be used to store the working fluid components. The liquid natural gas supply 270 is already present at the site for vaporization 280. The liquid natural gas supply 270 may be used, therefore, not only for vaporization 280, but also for use as a component of the working fluid in the power generation cycle 290.

The use of the natural gas as the base for forming the working fluid also allows for use of smaller storage tanks for the respective additional components of the working fluid. Moreover, use of the natural gas may eliminate the need to store methane—typically one of the largest components of working fluid.

Figure 1B:
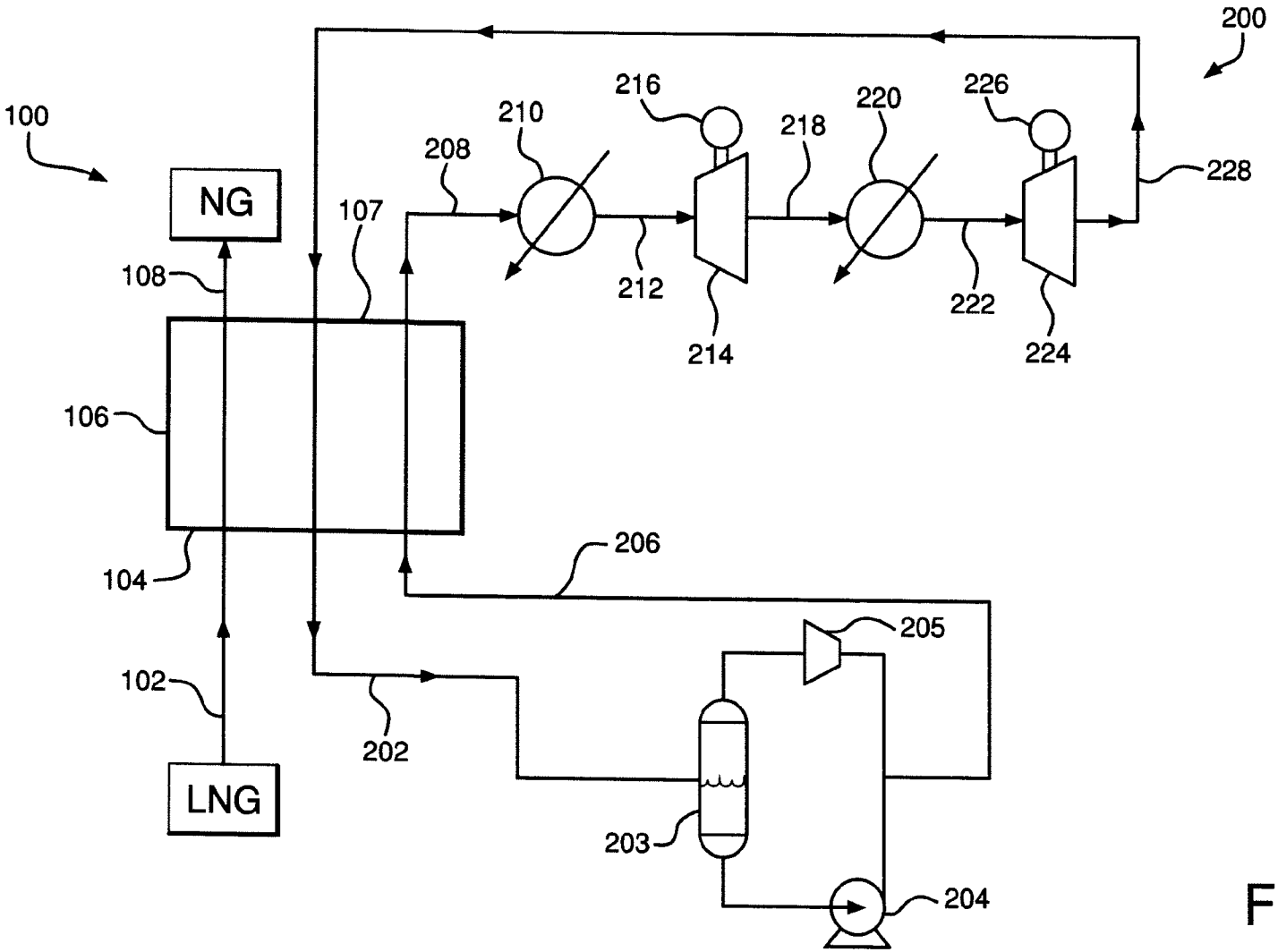
FIG. 1*b* is a flow diagram illustrating an exemplary power generation system in accordance with an embodiment of the present invention.

In one embodiment, the exhaust working fluid from the last expander in the power generation cycle may be partially condensed after being cooled in the main heat exchanger 106 (as in FIG. 1*b*, for example). In another embodiment, the exhaust working fluid from the last expander in the power generation cycle may be fully condensed after being cooled in the main heat exchanger 106 (as in FIG. 1*a*, for example). In yet another embodiment, the exhaust working fluid from the last expander in the power generation cycle may be substantially condensed (i.e., condensed such that less than 10% of the working fluid is a vapor) after being cooled in the main heat exchanger 106 (also as in FIG. 1*b*, for example). Fully condensing the exhaust working fluid in heat exchanger 106 may be advantageous because a phase separator is not required when the exhaust working fluid is fully condensed leading to cost savings. Because remixing is not required when the exhaust working fluid is fully condensed, there is less potential for thermodynamic mixing losses.

When the working fluid is not completely condensed through cooling in the heat exchanger 106, a phase separator 203, as illustrated in FIG. 1*b*, may be used to separate the liquid and vapor from stream 202. The liquid fraction of the working fluid may be pressurized by the pump 204, for example. The vapor fraction of the working fluid may be compressed by the compressor 205, for example. The resultant streams from pump 204 and compressor 205 may then be combined in line 206 to be sent through the cold end 104 of the main heat exchanger 106.

Figure 3:
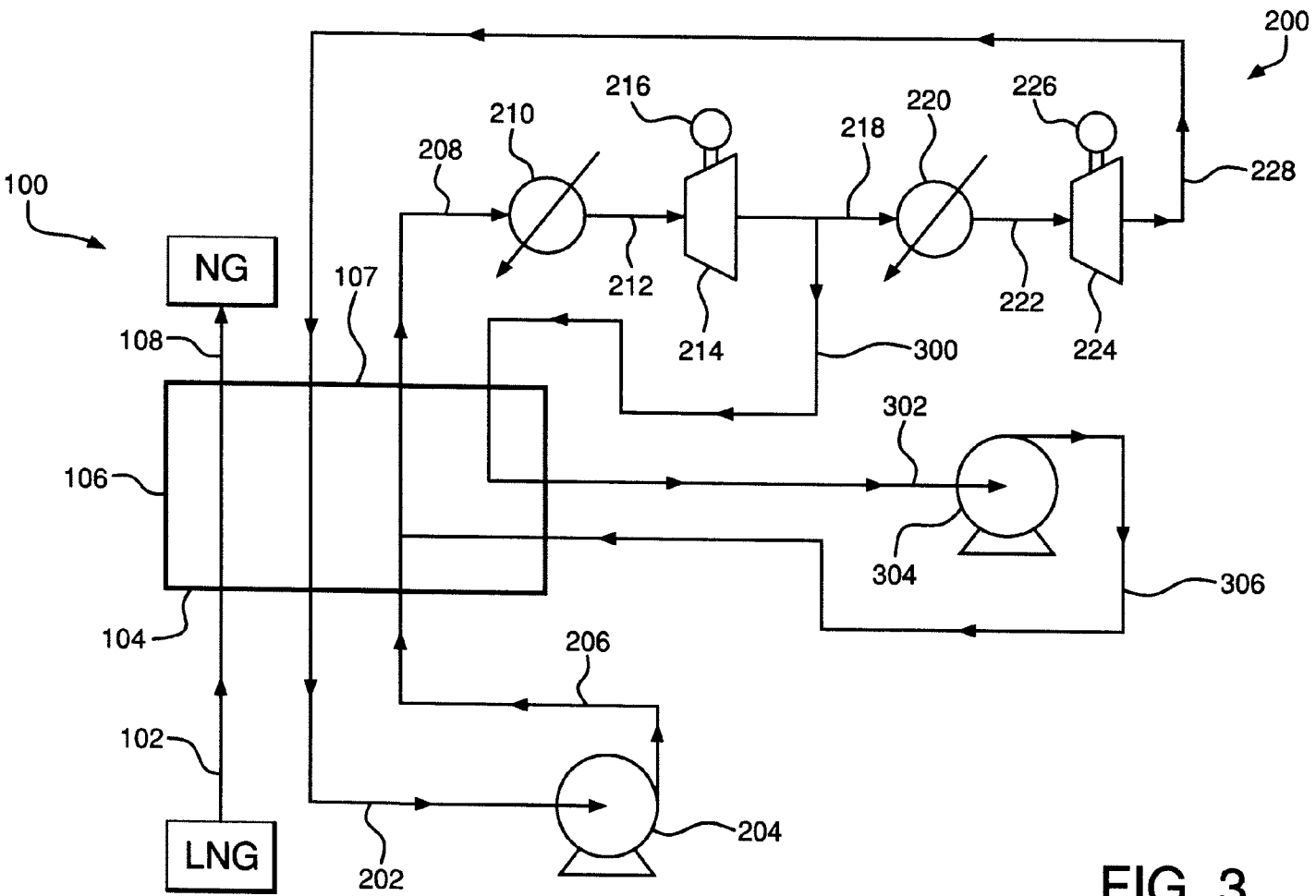
FIG. 3 is a flow diagram illustrating an exemplary power generation system incorporating a split stream in accordance with an embodiment of the present invention.

In FIG. 3, elements and fluid streams that correspond to elements and fluid streams in the embodiment illustrated in FIGS. 1*a* and 1*b* have been identified by the same number. Referring to the embodiment illustrated in FIG. 3, a split stream 300 may be taken from the exhaust working fluid of each expander, except for the lowest pressure expander. In the exemplary embodiment illustrated in FIG. 3, a split stream 300 may be first cooled and condensed by passing the split stream 300 through a section of the main heat exchanger 106. The cooled and condensed split stream in line 302 may then be pressurized by a pump 304. The pressurized split stream in line 306 may be reintroduced into the main heat exchanger 106 for heating. The heated split stream may then be reintroduced into the original line 206 for further heating in the main heat exchanger 106. Use of split streams 300 may allow, for example, for more efficient matching of heat supply and heat demand.

As an alternative, split stream 306 may be reheated in heat exchanger 106 separately from stream 206. In such an event, both warmed streams would be combined at the warm-end of the heat exchanger to form stream 208.

Use of one of the exemplary embodiments, where the working fluid is heated to a temperature of 110° C. prior to expansion, may reach a thermal efficiency close to 29%, for example. The thermal efficiency is calculated by subtracting the work required for operation of the pump from the work produced by the expander(s) and dividing the resultant net work by the heat supplied to the process in heaters 210 and 220, for example.

EXAMPLES

A comparison was performed between a Nitrogen Brayton cycle and an exemplary power generation system of the present invention. A Nitrogen Brayton cycle, as used here, operates as follows. Cold nitrogen gas is compressed from a low pressure to a high pressure (in a cold compressor and at a temperature near that of the incoming liquid natural gas) then warmed in a heat exchanger (or exchangers), then expanded from a high pressure to low pressure, then returned and cooled back to the initial state. The cold from the liquid natural gas is used to provide a fraction of the cooling of the low pressure nitrogen. The net work produced is the work output of the warm or hot expander less the work input of the cold compressor For this example, a liquid natural gas having a composition of 0.4 mol % nitrogen, 96.3 mol % methane, and 3.3 mol % ethane was introduced at pressure of 76 bar absolute. As illustrated in Table 1 below, the power generated by the exemplary system of the present invention was greater than that of the Nitrogen Brayton cycle, even though the temperature level into the expander was hotter for the Nitrogen Brayton cycle.

The process of the exemplary system used a pump that consumes less power than the cold compressor used by the Nitrogen Brayton cycle. The exemplary system also used two expanders while the Nitrogen Brayton cycle used only a single expander. The expander of the Nitrogen Brayton cycle, however, had a much higher power rating (larger size). The results of comparison are as follows:

TABLE I

| Nitrogen ($N_2$) Brayton System | Exemplary System of the Present Invention |
|---|---|
| Capacity: 3800 metric tons per day (mTPD) | Capacity: 4000 metric tons per day (mTPD) |
| Nitrogen Heated To: 260° C. | Working Fluid Heated To: 110° C. |
| Expander Capacity: 20,000 W | Expander Capacity: 11,235 kW and 6,641 kW |
| Cold Compressor Capacity: 12,300 kW | Pump Capacity: 3,375 kW |
| Net Power Produced: 7,700 kW | Net Power Produced: 14,501 kW |

The composition of the working fluid for the exemplary system was as follows:

TABLE II

| Composition | Mole Fraction |
|---|---|
| Nitrogen | 0.0781 |
| Methane | 0.3409 |
| Ethane | 0.4137 |
| Pentane | 0.1673 |

Table III illustrates how varying the nitrogen content of the working fluid affects the performance of the energy recovery process when the working fluid consists of nitrogen, methane, ethane, and pentane.

Table IV illustrates the similar effects of nitrogen when the working fluid consists of nitrogen, methane, ethylene, and n-butane. The results in Tables III and IV were obtained by varying the nitrogen flow rate in the working fluid and then optimizing the flow rates of the other components (i.e., the methane, ethane, and pentane from Table III and the methane, ethylene, and n-butane in Table IV). That is to say, for a given level of nitrogen, the composition of the other components was adjusted to achieve the highest net power output. The liquid natural gas flow rate was 4000 mTPD. Also, the UA of the main heat exchanger (the product of the heat transfer coefficient of the heat exchanger (U) and the heat exchanger area (A)) and the efficiencies of the expanders and pump were fixed.

TABLE III

| Component | | | | | | | | | | | |
|---|---|---|---|---|---|---|---|---|---|---|---|
| Nitrogen (mol %) | 0 | 0.40 | 0.87 | 2.15 | 3.01 | 4.26 | 6.35 | 7.81 | 8.53 | 9.83 | 10.66 |
| Methane (mol %) | 45.8 | 43.6 | 43.5 | 42.2 | 41.1 | 39.2 | 36.3 | 34.1 | 33.1 | 32.6 | 33.5 |
| Ethane (mol %) | 33.6 | 36.0 | 35.8 | 35.9 | 36.8 | 37.8 | 39.8 | 41.4 | 42.3 | 44.3 | 44.7 |
| Pentane (mol %) | 20.7 | 20.0 | 19.9 | 19.7 | 19.1 | 18.8 | 17.5 | 16.7 | 16.1 | 13.3 | 11.1 |
| Net Recovered Power (kW) | 12,710 | 13,315 | 13,421 | 13,761 | 13,915 | 14,118 | 14,400 | 14,501 | 14,481 | 14,203 | 13,477 |

FIG. 4 is a graphical illustration 400 comparing the nitrogen content of the working fluid with the net recovered power (kW) in Table III.

presumption that it would be difficult (or inefficient) to condense a component that was more volatile than methane (the major component of liquid natural gas).

TABLE IV

| Component | | | | | | | | | | | |
|---|---|---|---|---|---|---|---|---|---|---|---|
| Nitrogen (mol %) | 0.37 | 2.3 | 4.35 | 5.75 | 6.17 | 7.88 | 9.2 | 9.8 | 10.6 | 11.2 | 12.2 |
| Methane (mol %) | 42.4 | 41.6 | 42.2 | 36.6 | 36.2 | 32.2 | 31.0 | 29.0 | 28.1 | 29.1 | 30.3 |
| Ethylene (mol %) | 34.8 | 34.2 | 35.9 | 36.0 | 35.9 | 39.5 | 39.5 | 41.7 | 41.9 | 41.9 | 43.7 |
| n-butane (mol %) | 22.0 | 22.0 | 22.7 | 21.7 | 21.7 | 20.4 | 20.3 | 19.6 | 19.4 | 17.8 | 13.8 |
| Net Recovered Power (kW) | 13,571 | 13,858 | 14,117 | 14,373 | 14,430 | 14,640 | 14,786 | 14,788 | 14,636 | 14,330 | 13,667 |

FIG. 5 is a graphical illustration 500 comparing the nitrogen content of the working fluid with the net recovered power (kW) in Table IV.

Table V illustrates how removal of the nitrogen content of the working fluid in an exemplary case while keeping the other three components in the same relative ratios affects the performance of the energy recovery process when the working fluid consists of nitrogen, methane, ethane, and pentane.

TABLE V

| Component | | |
|---|---|---|
| Nitrogen (mol %) | 7.81 | 0 |
| Methane (mol %) | 34.1 | 37.0 |
| Ethane (mol %) | 41.4 | 44.9 |
| Pentane (mol %) | 16.7 | 18.1 |
| Net Recovered Power (kW) | 14,501 | 12,351 |

The examples above indicate an optimal content of the nitrogen in the working fluid may be, for example, greater than 2 mol %, and may preferably be greater than 6 mol %, even when the working fluid is fully condensed in the power generation process cycle.

Because nitrogen gas has a very low boiling point of approximately −195.8° C., which is far below the temperature range of liquid natural gas vaporization, working fluids that contained significant amounts of nitrogen were traditionally not used in a vaporizing of liquid natural gas process in conjunction with a Rankine cycle for power generation. Furthermore, and traditionally, when nitrogen was used as a component of the working fluid, the working fluid was first partially condensed, removed from the exchanger, sent to a vapor-liquid separator, and the resultant vapor returned to the exchanger and totally condensed—the use of the phase separator, in effect, creates several working fluids of different composition in the same process. The aversion to the use of nitrogen in the working fluid was most likely driven by the In fact, we have found that: 1) the incorporation of significant levels nitrogen into the working fluid can be accomplished when the fluid is totally condensed, and 2) it is beneficial to do so. The explanation for why this is follows.

FIG. 6 is a graphical illustration 600 of the cooling curve of the main heat exchanger when the nitrogen content of the working fluid was approximately 7.81 mol %. FIG. 7 is a graphical illustration 700 of the cooling curve of the main heat exchanger when the nitrogen content of the working fluid was approximately 0.40 mol %. The working fluid in the study for obtaining FIGS. 6-7 comprised nitrogen, methane, ethane, and pentane in accordance with the examples shown in Table III (and FIG. 4). FIGS. 6-7 can be studied to understand the beneficial result of adding a judicious amount of nitrogen. Essentially, the addition of nitrogen results in a more uniform heat transfer temperature difference between the cooling stream and warming stream—particularly at the cold-end. The tightening of the temperature difference between streams in FIG. 6 (a smaller average temperature difference between the heat exchanging streams) is indicative of a more efficient process. Furthermore, thermodynamic fundamentals teach that the temperature difference between streams should be minimized at the colder temperatures (the lost work is proportional to 1/T, where T is absolute temperature).

As illustrated in FIG. 6, when the nitrogen content in the working fluid was 7.81 mol %, the largest temperature difference between the cooling stream (indicated by T-Hot) and the warming stream (indicated by T-Cold) in the main heat exchanger was no greater than 15° C. In contrast, and as illustrated in FIG. 7, the largest temperature difference between the cooling stream and the warming stream in the main heat exchanger was more than 50° C. near the cold end of the main heat exchanger when the nitrogen content in the working fluid was reduced to 0.40 mol %. Thus, in this range, as the nitrogen content of the working fluid was decreased, the temperature difference between the T-Hot curve and the T-Cold curve increased, and more available work was lost in the heat transfer process leading to less efficient power generation.

As illustrated in FIG. 1*b*, one embodiment of the present invention anticipates that the working fluid need not be totally condensed to utilize the beneficial effect of adding nitrogen to the mix. However, total condensation has additional benefits. For example, in FIG. 1*b*, cold compressor 205 operates by introducing work at the coldest temperature. Cold pump 204 also introduces work, but that work, on a per mole basis, is significantly less that of the cold compressor. Work at the cold-end robs refrigeration from the LNG, thus reducing the power production. So, one can see that pumping a liquid is desirable to compressing a vapor. Additionally, it is understood that the cost of a pump is considerably less than the cost of a compressor.

With respect to the traditional processes, where the working fluid was partially condensed, phase separated, then fully condensed, the present invention has been simplified. Systems with multiple phase separation stages are clearly more complex due to additional equipment pieces such as phase separators, pumps, and pipelines, as well as penetrations in heat exchanger(s). Additionally, when these separated streams recombine, there are thermodynamic mixing losses that result from mixing streams of different composition—these mixing losses manifest themselves as reduce power recovery. Our results show, in contrast to the common belief that any significant amount of nitrogen in the working fluid would warrant the use of a phase separator, a judicious amount of nitrogen in the working fluid can be completely condensed and still provide a very desirable performance benefit. This allows us to greatly simplify the process, thereby reducing the cost of the system.

While aspects of the present invention has been described in connection with the preferred embodiments of the various figures, it is to be understood that other similar embodiments may be used or modifications and additions may be made to the described embodiment for performing the same function of the present invention without deviating therefrom. The claimed invention, therefore, should not be limited to any single embodiment, but rather should be construed in breadth and scope in accordance with the appended claims.

The invention claimed is:

1. A method for generating power in a vaporization of liquid natural gas process, the method comprising the steps of:

(a) pressurizing a working fluid;

(b) heating and vaporizing the pressurized working fluid;

(c) expanding the heated and vaporized working fluid in two or more expanders in series for the generation of power, the working fluid exiting the two or more expanders in series comprises:

2-11 mol % nitrogen, methane, a third component whose boiling point is greater than or equal to that of propane, wherein the third component comprises at least 11 mol % of the working fluid; and a fourth component comprising ethane or ethylene;

(d) cooling the expanded working fluid such that the cooled working fluid is at least substantially condensed; and (e) recycling the cooled working fluid into step (a), wherein the cooling of the expanded working fluid occurs through indirect heat exchange with a pressurized liquefied natural gas stream in a heat exchanger, and wherein the flow rate of the expanded working fluid at an inlet of the heat exchanger is equal to the flow rate of the expanded working fluid at an outlet of the heat exchanger.

2. The method of claim 1, wherein the cooled working fluid is fully condensed.

3. The method of claim 1, further comprising reheating the expanded working fluid and then reexpanding the working fluid for power generation.

4. The method of claim 1, wherein the working fluid exiting the one or more expanders comprises 6-10.6 mol % nitrogen.

5. The method of claim 1, wherein the boiling point of the third component is less than that of hexane.

6. The method of claim 1, further comprising splitting the expanded working fluid into a first stream and a second stream, wherein the first stream is cooled in step (d) of claim 1, and wherein the second stream is repressurized and then heated in step (b) of claim 1.

7. A method for generating power in a vaporization of liquid natural gas process, the method comprising the steps of:

(a) pressurizing a working fluid;

(b) heating and vaporizing the pressurized working fluid;

(c) expanding the heated and vaporized working fluid in two or more expanders in series for the generation of power, wherein the working fluid comprises:

2-11 mol % nitrogen, natural gas, a third component whose boiling point is greater than or equal to that of propane, wherein the third component comprises at least 11 mol % of the working fluid; and a fourth component comprising ethane or ethylene;

(d) cooling the expanded working fluid such that the cooled working fluid is at least partially condensed; and (e) recycling the at least partially condensed working fluid into step (a), wherein the cooling of the expanded working fluid occurs through indirect heat exchange with a pressurized liquefied natural gas stream in a heat exchanger, and wherein the flow rate of the expanded working fluid at an inlet of the heat exchanger is equal to the flow rate of the expanded working fluid at an outlet of the heat exchanger.

8. The method of claim 7, wherein the working fluid comprises nitrogen in excess of the amount of nitrogen naturally occurring in the natural gas.

9. The method of claim 7, further comprising reheating the expanded working fluid and then reexpanding the working fluid for power generation.

10. The method of claim 7, further comprising splitting the expanded working fluid into a first stream and a second stream, wherein the first stream is cooled in step (d) of claim 7, and wherein the second stream is repressurized and then heated in step (b) of claim 7.

11. The method of claim 7, wherein the working fluid comprises 6-10.6 mol % nitrogen.

12. The method of claim 7, wherein the boiling point of the third component is less than that of hexane.

13. In a method for generating power in a vaporization of liquid natural gas process, the method comprising the steps of:

(a) pressurizing a working fluid;

(b) heating and vaporizing the pressurized working fluid;

(c) expanding the heated and vaporized working fluid in two or more expanders in series for the generation of power;

(d) cooling the expanded working fluid; and (e) recycling the cooled working fluid into step (a), wherein the cooling of the expanded working fluid occurs through indirect heat exchange with a pressurized liquefied natural gas stream in a heat exchanger, the improvement comprises:

a working fluid comprising 2-11 mol % nitrogen and at least 11 mol % of a second component whose boiling point is greater than or equal to that of propane, the flow rate of the expanded working fluid at an inlet of the heat exchanger is equal to the flow rate of the expanded working fluid at an outlet of the heat exchanger, and wherein the cooled working fluid is at least substantially condensed.

14. The method of claim 13, wherein the working fluid is fully condensed.

15. An apparatus for power generation for use in a vaporization of liquefied natural gas system, the apparatus comprising:

at least two expansion devices in series;

at least one heating device;

at least one condenser; and a working liquid having multiple components, wherein the working liquid comprises:

2-11 mol % nitrogen, a second component comprising methane or natural gas, a third component whose boiling point is greater than or equal to that of propane, wherein the third component comprises at least 11 mol % of the working fluid; and a fourth component comprising ethane or ethylene.

16. The apparatus of claim 15, wherein the working fluid is at least partially condensed by the at least one condenser.

17. The apparatus of claim 15, wherein the working fluid is at least substantially condensed by the at least one condenser.

18. The apparatus of claim 15, wherein the working fluid is fully condensed by the at least one condenser.

19. The apparatus of claim 15, wherein the working fluid comprises 6-10.6 mol % nitrogen.

20. The apparatus of claim 15, wherein the boiling point of the third component is less than that of hexane.

* * * * *